US007871944B2

(12) United States Patent
Sanders et al.

(10) Patent No.: US 7,871,944 B2
(45) Date of Patent: Jan. 18, 2011

(54) PROCESS FOR APPLYING INTERFACE COATINGS AND MANUFACTURING COMPOSITE MATERIALS USING SAME

(75) Inventors: Stuart A. Sanders, Palm Beach Gardens, FL (US); Imelda P. Smyth, North Palm Beach, FL (US)

(73) Assignee: United Technologies Corporation, Hartford, CT (US)

( * ) Notice: Subject to any disclaimer, the term of this patent is extended or adjusted under 35 U.S.C. 154(b) by 1121 days.

(21) Appl. No.: 11/500,859

(22) Filed: Aug. 8, 2006

(65) Prior Publication Data

US 2008/0163996 A1 Jul. 10, 2008

(51) Int. Cl.

| | |
|---|---|
| ***D04H 1/00*** | (2006.01) |
| ***B32B 27/12*** | (2006.01) |
| ***B32B 3/00*** | (2006.01) |
| ***B32B 27/04*** | (2006.01) |
| ***B05D 1/36*** | (2006.01) |

(52) U.S. Cl. ..... 442/59; 442/68; 428/292.1; 428/298.7; 427/412

(58) Field of Classification Search ..... None
See application file for complete search history.

(56) References Cited

U.S. PATENT DOCUMENTS

| | | | | |
|---|---|---|---|---|
| 5,985,773 | A * | 11/1999 | Lee | 442/89 |
| 6,352,567 | B1 | 3/2002 | Windisch et al. | |
| 2007/0197114 | A1 * | 8/2007 | Grove | 442/180 |

FOREIGN PATENT DOCUMENTS

| | | | |
|---|---|---|---|
| JP | 3146767 | A | 6/1991 |
| JP | 9228248 | A | 9/1997 |
| WO | 2004050214 | A1 | 6/2004 |

* cited by examiner

*Primary Examiner*—D. Lawrence Tarazano
*Assistant Examiner*—Camie S Thompson
(74) *Attorney, Agent, or Firm*—Bachman & LaPointe P.C.

(57) ABSTRACT

A process for applying an interface coating includes the step of applying an interface coating material upon at least one surface of a fiber-based substrate. The interface coating material may be composed of a sizing agent, a ceramic powder and optionally at least one of the following agents: a dispersing agent, a deflocculating agent or a surface wetting agent.

27 Claims, 2 Drawing Sheets

PROCESS FOR APPLYING INTERFACE COATINGS AND MANUFACTURING COMPOSITE MATERIALS USING SAME

GOVERNMENT RIGHTS

The United States Government may have certain rights in the invention pursuant to contract number NAS3-26385 awarded by National Aeronautics and Space Agency.

FIELD OF THE INVENTION

The invention relates to coatings and, more particularly, relates to processes for applying coatings.

BACKGROUND OF THE INVENTION

Fiber/matrix interface coatings for ceramic and metal matrix composites are typically applied by chemical vapor deposition processes (CVD). CVD coating processes are cost prohibitive due to the equipment and special tooling utilized. CVD coating processes in this context also represent a separate processing step to the overall composite fabrication. In addition, the resultant CVD coatings are susceptible to damage from handling, and in applications requiring woven fiber the coating must therefore be applied after weaving. As a result, an additional de-sizing operation is typically required to remove existing protective sizings from the woven fabric and facilitate adherence of the interface coating.

Therefore, there exists a need to develop a coating process able to apply a coating prior to weaving without requiring an additional processing step yet still cost effective and efficient as compared to CVD.

SUMMARY OF THE INVENTION

In accordance with one aspect of the present invention, a process for applying an interface coating broadly comprises applying an interface coating material upon at least one surface of a fiber-based substrate, the interface coating material comprising a sizing agent, a ceramic powder and optionally at least one of the following agents: a dispersing agent, a deflocculating agent or a surface wetting agent.

In accordance with another aspect of the present invention, a process for manufacturing a composite material broadly comprises dipping at least one surface of a fiber-based substrate into a slurry to form a coated fiber-based substrate on the at least one surface, the slurry broadly comprises a sizing agent, a ceramic powder and optionally at least one of the following agents: a dispersing agent, a deflocculating agent or a surface wetting agent; heat treating the coated fiber-based substrate to form a fiber-based substrate having an interface coating; impregnating the fiber-based substrate with a matrix material to form a composite material.

In accordance with another aspect of the present invention, a process for manufacturing a composite material broadly comprises dipping a plurality of unwoven fibers into a slurry to form a plurality of coated, unwoven fibers, the slurry broadly comprises a sizing agent, a ceramic powder and optionally at least one of the following agents: a dispersing agent, a deflocculating agent or a surface wetting agent; processing the plurality of coated, unwoven fibers to form a coated fiber-based substrate; heat treating the coated fiber-based substrate to form a fiber-based substrate having an interface coating; impregnating the fiber-based substrate with a matrix material to form a composite material.

In accordance with yet another aspect of the present invention, a process for manufacturing a composite material broadly comprises spraying a plurality of unwoven fibers with a coating material to form a plurality of coated, unwoven fibers, the coating material comprising a sizing agent, a ceramic powder and optionally at least one of the following agents: a dispersing agent, a deflocculating agent or a surface wetting agent; processing the plurality of coated, unwoven fibers to form a coated fiber-based substrate; heat treating the coated fiber-based substrate to form a fiber-based substrate having an interface coating; and impregnating the fiber-based substrate with a matrix material to form a composite material.

In accordance with still yet another aspect of the present invention, a process for manufacturing a composite material broadly comprises spraying a fiber-based substrate with a coating material to form a coated fiber-based substrate, the coating material comprising a sizing agent, a ceramic powder and optionally at least one of the following agents: a dispersing agent, a deflocculating agent or a surface wetting agent; heat treating a coated fiber-based substrate to form a fiber-based substrate having an interface coating; and impregnating the fiber-based substrate with a matrix material to form a composite material.

In accordance with another aspect of the present invention, a composite material broadly comprises a fiber-based composite material including a reaction product of a mixture comprising a sizing agent, a ceramic powder and optionally at least one of the following agents: a dispersing agent, a deflocculating agent or a surface wetting agent.

The details of one or more embodiments of the invention are set forth in the description below. Other features, objects, and advantages of the invention will be apparent from the description, and from the claims.

BRIEF DESCRIPTION OF THE DRAWINGS

Like reference numbers and designations in the various drawings indicate like elements.

DETAILED DESCRIPTION

The processes described herein proposes eliminating costly equipment and special tooling by introducing interface coating materials into the sizing operation commonly performed prior to impregnating fiber-based materials with a matrix material to form composite materials.

Figure 1:
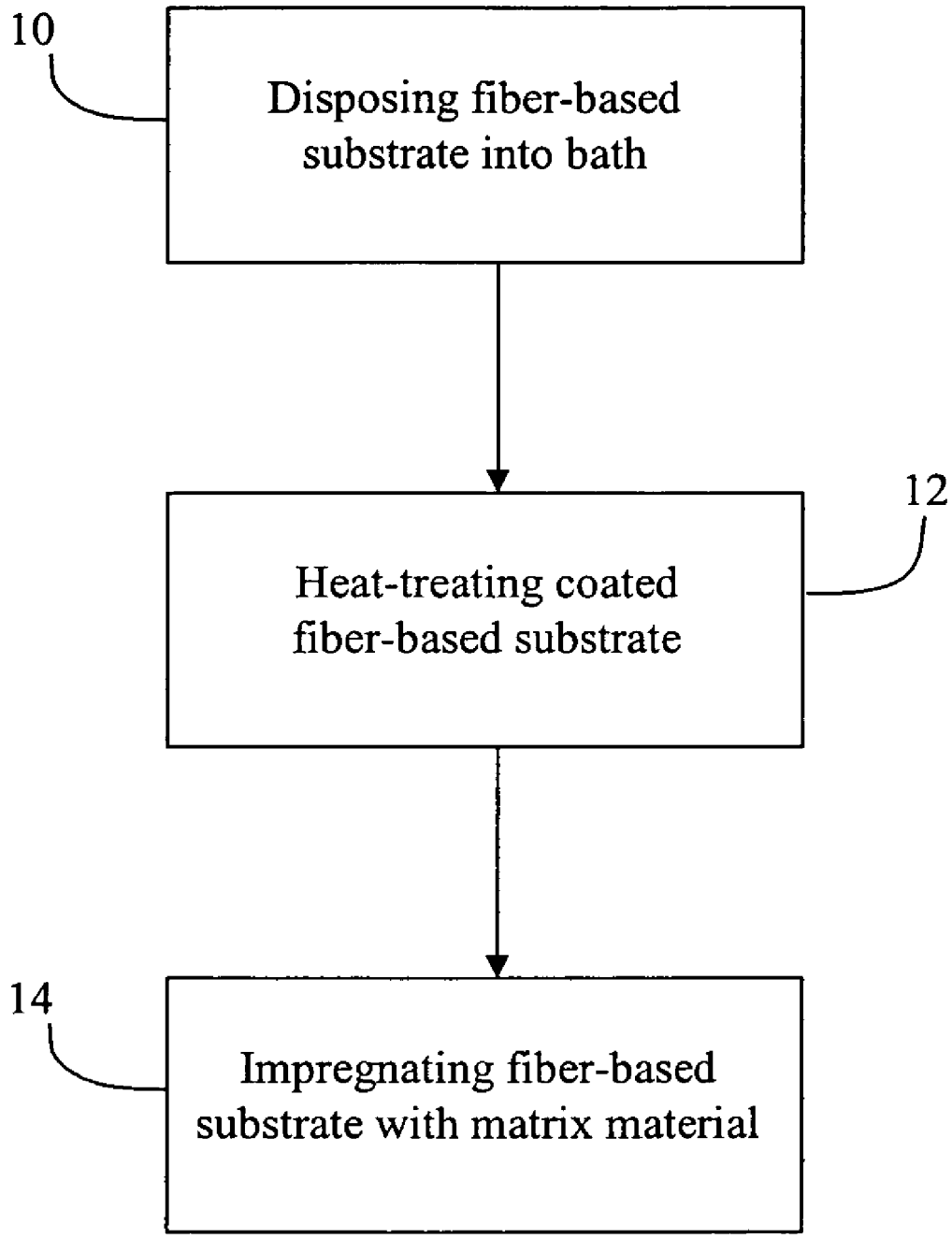
FIG. 1 is a flowchart representing an exemplary process for manufacturing a composite material.
Figure 2:
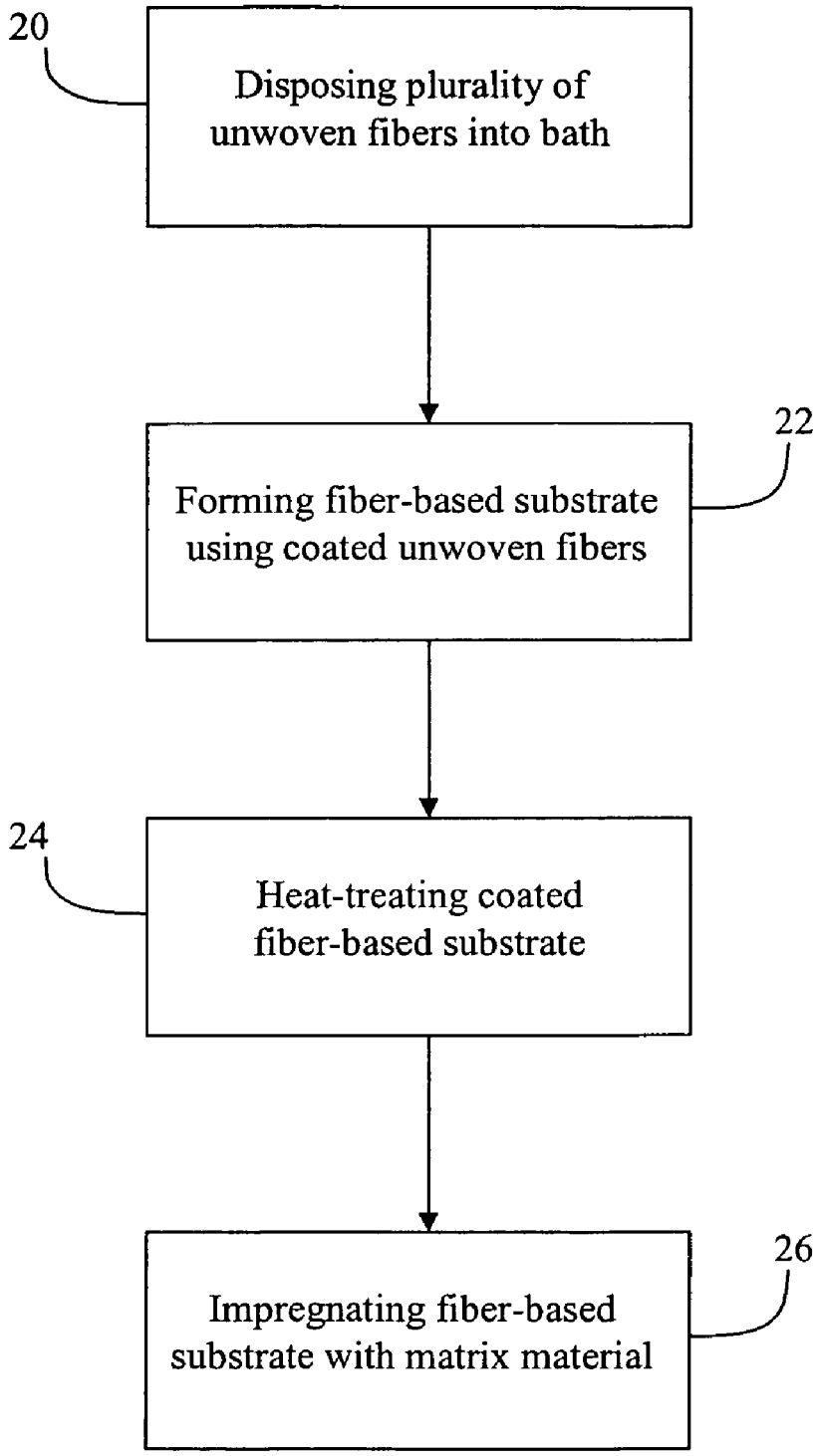
FIG. 2 is a flowchart representing another exemplary process for manufacturing a composite material.

Referring now to FIGS. 1 and 2, the process for sizing a fiber-based material may comprise disposing a fiber-based substrate into a bath at step 10 of FIG. 1. The fiber-based substrate may be dipped and/or immersed as many times as necessary in order to coat the entirety of at least one surface of the substrate. In the alternative, the bath solution may be prepared as a spraying agent and sprayed onto at least one surface of the fiber-based substrate. The fiber-based substrate may comprise any one or more of a number of fiber-based materials commonly employed in manufacturing aeronautical components such as, for example, at least one refractory metal. The substrate may be a woven fiber-based substrate or, in the alternative, may be a plurality of unwoven fibers such as at step 20 of FIG. 2. In such an embodiment, the plurality of coated, unwoven fibers may be woven afterwards at step 22 of FIG. 2 prior to being impregnated with a matrix material to form a composite material. Whether woven or unwoven, the fiber-based material may possess a fiber diameter on the order of 10 microns.

The bath may comprise a slurry exhibiting a stable colloidal suspension of at least one sizing agent, at least one ceramic powder and optionally any one of the following agents: at least one dispersing agent, at least one deflocculating agent or at least one surface wetting agent. Conventional sizing operations do not include ceramic powders as such composite interface coatings are typically applied in separate CVD processes.

The ceramic powder may be an ultrafine ceramic powder as known to one of ordinary skill in the art. Suitable ultrafine ceramic powders for use herein may comprise particles of various shapes ranging from spherical to acicular and may possess an average particle size (e.g., diameter or length) of about 50 nanometers to 1 micron. The type of ultrafine ceramic powders selected for use herein may be selected based upon the intended use of the resultant composite material, compatibility of interface materials, and the like, as known to one of ordinary skill in the art.

Suitable sizing agents may include one or more of the following agents: unsaturated urethane compounds, unsaturated ester compounds, epoxy resins, starches, starch derivatives, cellulose derivatives, acrylic polymers, polyvinyl acetates, polyvinyl alcohols, alginates, natural gums, emulsions or dispersions of polyesters, polyurethanes, and styrene copolymers, and the like.

Suitable dispersing agents may include one or more of the following agents: water insoluble carbonates, carboxylic acid salts, oxides and mixed oxides of metals from periodic table groups II, III and/or IV, for example, calcium carbonate, magnesium carbonate, barium carbonate, zinc carbonate, magnesium stearate, calcium palmitate, zinc stearate, aluminum stearate, zinc oxide, aluminum oxide, titanium dioxide, silicon dioxide, magnesium silicate, calcium silicate, aluminum silicate, and combinations thereof; insoluble hydroxides such as magnesium hydroxide, calcium hydroxide; magnesium phosphate, fumed silica; aluminum sulfate and other insoluble sulfates; organic polymeric dispersants include a copolymer of polyvinyl chloride with other unsaturated monomers such as vinyl acetate or vinyl alcohol; acrylic resins; polyimides; epoxy resins and ionic detergents; and the like.

Suitable deflocculating agents may include one or more of the following agents: organic deflocculating agents such as polyacrylic acid, phospho-organic or alkyl-sulfonic acid, sodium polyalkylallyl sulfonate, polyacrylic acid salt, and the like; and, inorganic deflocculating agents such as sodium hexametaphosphate, sodium silicate, and the like.

Suitable surface wetting agents may include soaps, alcohols (e.g., glycols), fatty acids, combinations comprising at least one of the foregoing agents, and the like, as known to one of ordinary skill in the art. For example, at least one suitable surface wetting agent is "STEOL" CA460, an ammonium laureth sulfate compound commercially available from the Stepen Company, Northfield, Ill.

In addition, one or more viscosity modifiers may be added to the bath or, in the alternative, spraying solution, in order to achieve the desired film forming characteristics. Suitable viscosity modifiers may include any one or more of a number of viscosity modifiers known to one of ordinary skill in the art. For example, at least one suitable viscosity modifier are acrylic-styrene copolymers "CARBOSET" GA-1161 and 1162, both commercially available from the B. F. Goodrich Chemical Company, Charlotte, N.C.

After coating the substrate, the coated substrate may then be subjected to a heat treatment at step 12 of FIG. 1 and step 24 of FIG. 2 to drive off fugitive constituents of the sizing solution as known to one of ordinary skill in the art, thereby leaving the functional constituents of the interface coating intact on the substrate. The substrate may then be impregnated and/or infiltrated with a matrix material at step 14 of FIG. 1 and step 26 of FIG. 2 as known to one of ordinary skill in the art to form a composite material. The resultant composite material may then comprise the fiber, interface coating, and matrix, and may also include the residual reaction product of a mixture comprising a sizing agent, a ceramic powder and optionally any one or more of the following agents: a dispersing agent, a deflocculating agent or a surface wetting agent.

The low cost aspect of the processes described herein are realized directly through the reduced number of process steps, reduced price of raw materials consumed, and reduced use and reliance upon expensive capital equipment and special tooling. Low costs are also indirectly realized through processing flexibility resulting from the increased ease of handling the coated fiber-based substrates and the potential to weave the coated fiber-based substrates.

One or more embodiments of the present invention have been described. Nevertheless, it will be understood that various modifications may be made without departing from the spirit and scope of the invention. Accordingly, other embodiments are within the scope of the following claims.

What is claimed is:

1. A process for applying an interface coating, comprising: applying an interface coating material upon at least one surface of a fiber-based substrate, said interface coating material consisting of a sizing agent, a ceramic powder and optionally at least one of the following agents: a dispersing agent, a deflocculating agent, a surface wetting agent, and at least one viscosity modifier.

2. The process of claim 1, wherein said ceramic powder has an average particle size of about 50 nanometers to 1 micron.

3. The process of claim 1, wherein said applying step comprises dipping said at least one surface of said fiber-based substrate into a slurry comprising said interface coating material.

4. The process of claim 3, wherein said slurry has a viscosity sufficient to achieve film forming characteristics.

5. The process of claim 3, wherein said slurry includes a viscosity modifier.

6. The process of claim 1, wherein said applying step comprises spraying said at least one surface of said fiber-based substrate with said interface coating material.

7. The process of claim 6, wherein said interface coating material has a viscosity sufficient to achieve film forming characteristics.

8. The process of claim 1, wherein said fiber-based substrate comprises at least one refractory metal.

9. The process according to claim 1, wherein said coating material includes a sizing agent selected from the group consisting of unsaturated urethane compounds, unsaturated ester compounds, epoxy resins, starches, starch derivatives, cellulose derivatives, acrylic polymers, polyvinyl acetates, polyvinyl alcohols, alginates, natural gums, emulsions or dispersions of polyesters, polyurethanes, and styrene copolymers; a dispersing agent selected from the group consisting of water insoluble carbonates, carboxylic acid, salts, oxides, and mixed oxides of metals from periodic table groups II, III, and/or IV, insoluble hydroxides, magnesium phosphate, fumed silica, aluminum sulfate, a copolymer of polyvinyl chloride with other unsaturated monomers, acrylic resins, and polyimides, epoxy resins and ionic detergents; a deflocculating agent selected from the group of organic deflocculating agents and inorganic deflocculating agents; and a surface wetting agent selected from the group consisting of soaps, alcohols, and fatty acids.

10. A process for manufacturing a composite material, comprising:

dipping at least one surface of a fiber-based substrate into a slurry to form a coated fiber-based substrate on said at least one surface, said slurry consisting of a sizing agent, a ceramic powder and optionally at least one of the following agents: a dispersing agent, a deflocculating agent, a surface wetting agent, and a viscosity modifier.

11. The process of claim 10, wherein said ceramic powder has an average particle size of about 50 nanometers to 1 micron.

12. The process of claim 10, wherein said fiber-based substrate comprises at least one refractory metal.

13. The process of claim 10, wherein said slurry has a viscosity sufficient to achieve film forming characteristics.

14. A process for manufacturing a composite material, comprising:

dipping a plurality of unwoven fibers into a slurry to form a plurality of coated, unwoven fibers, said slurry consisting of a sizing agent, a ceramic powder and optionally at least one of the following agents: a dispersing agent, a deflocculating agent, a surface wetting agent, and a viscosity modifier;

processing said plurality of coated, unwoven fibers to form a coated fiber-based substrate;

heat treating said coated fiber-based substrate to form a fiber-based substrate having an interface coating; and impregnating said fiber-based substrate with a matrix material to form a composite material.

15. The process of claim 14, wherein said ceramic powder has an average particle size of about 50 nanometers to 1 micron.

16. The process of claim 14, wherein said fiber-based substrate comprises at least one refractory metal.

17. The process of claim 14, wherein said slurry has a viscosity sufficient to achieve film forming characteristics.

18. The process of claim 14, wherein said slurry includes a viscosity modifier.

19. A process for manufacturing a composite material, comprising:

spraying a plurality of unwoven fibers with a coating material to form a plurality of coated, unwoven fibers, said coating material consisting of a sizing agent, a ceramic powder and optionally at least one of the following agents: a dispersing agent, a deflocculating agent, and a surface wetting agent;

processing said plurality of coated, unwoven fibers to form a coated fiber-based substrate;

heat treating said coated fiber-based substrate to form a fiber-based substrate having an interface coating; and impregnating said fiber-based substrate with a matrix material to form a composite material.

20. The process of claim 19, wherein said ceramic powder has an average particle size of about 50 nanometers to 1 micron.

21. The process of claim 19, wherein said fiber-based substrate comprises at least one refractory metal.

22. A process for manufacturing a composite material, comprising:

spraying a fiber-based substrate with a coating material to form a coated fiber-based substrate, said coating material consisting of a sizing agent, a ceramic powder and optionally at least one of the following agents: a dispersing agent, a deflocculating agent, and a surface wetting agent;

heat treating a coated fiber-based substrate to form a fiber-based substrate having an interface coating; and impregnating said fiber-based substrate with a matrix material to form a composite material.

23. The process of claim 22, wherein said ceramic powder has an average particle size of about 50 nanometers to 1 micron.

24. The process of claim 22, wherein said fiber-based substrate comprises at least one refractory metal.

25. A composite material, comprising:

a fiber-based composite material including a reaction product of a mixture consisting of a sizing agent, a ceramic powder and optionally at least one of the following agents: a dispersing agent, a deflocculating agent, a viscosity modifier and a surface wetting agent.

26. The composite material of claim 25, wherein said ceramic powder has an average particle size of about 50 nanometers to 1 micron.

27. The composite material of claim 25, wherein said fiber-based composite material comprises at least one refractory metal.

* * * * *